US006167644B1

(12) United States Patent
Fox

(10) Patent No.: US 6,167,644 B1
(45) Date of Patent: Jan. 2, 2001

(54) ADVERTISING DISPLAY STANDARD

(76) Inventor: Andrew C. Fox, 11317 Acuff La., Lenexa, KS (US) 66215

( * ) Notice: Under 35 U.S.C. 154(b), the term of this patent shall be extended for 0 days.

(21) Appl. No.: 08/925,862

(22) Filed: Sep. 9, 1997

(51) Int. Cl.[7] ..... G09F 1/00
(52) U.S. Cl. ..... 40/124.2; 40/124.16; 40/124.14
(58) Field of Search ..... 40/124.14, 124.16, 40/651, 661.03, 539, 661.08, 124.2, 124.05

(56) References Cited

U.S. PATENT DOCUMENTS

| | | | | |
|---|---|---|---|---|
| 1,626,711 | * | 3/1927 | Ackeret | 40/539 |
| 1,987,567 | * | 1/1935 | Ziemmerman | 40/539 |
| 2,770,411 | * | 11/1956 | Mackay | 229/43 |
| 2,984,031 | | 5/1961 | Giesecke . | |
| 3,056,572 | | 10/1962 | Gelow . | |
| 3,422,555 | | 1/1969 | Woolf . | |
| 3,423,860 | | 1/1969 | Berry, Jr. et al. . | |
| 3,534,491 | * | 10/1970 | Girard | 40/124.16 |
| 3,571,958 | * | 3/1971 | Stevens | 40/124.14 |
| 3,706,150 | | 12/1972 | Greenberger . | |
| 3,711,977 | | 1/1973 | Blankenhorn . | |
| 3,881,649 | * | 5/1975 | Krautsack | 229/38 |
| 3,945,559 | * | 3/1976 | Krautsack | 229/38 |
| 3,977,109 | * | 8/1976 | Berry et al. | 40/124.1 |
| 4,113,109 | * | 9/1978 | Donnelli et al. | 211/49 |
| 4,152,851 | | 5/1979 | Goldstein . | |
| 4,161,074 | | 7/1979 | DePinna . | |
| 4,167,073 | | 9/1979 | Tang . | |
| 4,477,048 | | 10/1984 | Conway . | |
| 4,483,502 | | 11/1984 | Fast . | |
| 4,919,377 | | 4/1990 | Alexander et al. . | |
| 5,154,392 | * | 10/1992 | Voight | 40/539 |

* cited by examiner

*Primary Examiner*—Terry Lee Melius
*Assistant Examiner*—Fredrick Conley
(74) *Attorney, Agent, or Firm*—Lathrop & Gage, LC

(57) ABSTRACT

A display standard for displaying advertising away from a mounting surface comprises a planar piece of flexible material, which has a base member with top and bottom retaining flaps mateable with opposing channels of the mounting surface for securing the standard to the mounting surface. The flexible material further includes a display region for supporting advertising away from the mounting surface and opposing folding tabs to move the display region from a first position in which the display standard is substantially flat to a second position in which the display region is moved outwardly away from the mounting surface.

8 Claims, 8 Drawing Sheets

ADVERTISING DISPLAY STANDARD

BACKGROUND OF THE INVENTION

1. Field of Invention

This invention relates to display devices and, more particularly, to a three-dimensional display standard hingedly moveable from a single piece of flat material for displaying advertisement forwardly away from a mounting surface.

2. Statement of Related Art

Retail stores often are provided with counters having decorative molding around the shelves that have a pair of opposing grooves wherein price tags, advertising or other indicia may be snapped into the grooves. In order for this advertising to attract consumers, it is desirable for it to have three dimensions, i.e., the advertising display occupies the channel molding and also protrudes forwardly outwardly therefrom.

Various attempts have been made to provide a three-dimensional display standard for advertising. These standards generally are formed of a rigid plastic material that is formed to snap into the channeled molding. The pre-formed plastic display mounts are packaged and shipped to retail stores along with the advertising that is held by these mounts. However, the awkward three-dimensional shape of these mounts presents problems in packaging and increases shipping costs.

A previous attempt to fold display standards from flat stock is shown in U.S. Pat. No. 3,706,150. This patent disclosed a three-dimensional molding sign that is produced from flat stock. However, this standard permitted only limited three-dimensional display capabilities and did not provide sufficient structure to support advertising displays apart from printing on the outwardly protruding portion of the standard.

U.S. Pat. No. 3,056,572 discloses a display easel for carrying a display panel. This easel permits only limited three-dimensional capabilities as it is intended to provide a wider and longer display instead of a three-dimensional display.

A need therefore exists for an advertising display standard that is shipped flat to retail stores and that is foldable from the flat material into a three-dimensional advertising display for displaying advertisement forwardly from a mounting surface.

SUMMARY OF THE INVENTION.

It is accordingly a principal object of the present invention to provide a display standard for displaying advertising away from a mounting surface.

Another object of the present invention is to provide an advertising display standard that may be shipped flat to retail stores and that is foldable from the flat material into a three-dimensional advertising display for displaying advertisement forwardly from a mounting surface.

Another object of the present invention is to provide an economical three-dimensional advertising display standard that supports advertising away from the mounting surface. The foregoing object of the invention is achieved by providing a display standard for displaying advertising away from a mounting surface that has slots for supporting the display standard. The display standard comprises a planar piece of material. This material has a base member with top and bottom retaining flaps mateable with the slots of the mounting surface for securing the standard to the mounting surface. The standard further includes a display region for supporting advertising away from the mounting surface and opposing folding tabs to move the display region from a first position in which the display standard is substantially flat to a second position in which the display region is moved outwardly away from the mounting surface.

A second embodiment of the present invention includes a display standard for displaying advertising away from a mounting surface. The display standard comprises a planar piece of flexible material having a base member with an adhesive backing for retaining the display standard on the mounting surface The standard further includes a display region for supporting advertising away from the mounting surface, and opposing folding tabs to move the display region from a first position in which the display standard is substantially flat to a second position in which the display region is moved outwardly away from the mounting surface.

The foregoing features, objects and advantages of the invention will become apparent to those skilled in the art through the following detailed description of a preferred embodiment.

DETAILED DESCRIPTION OF THE PREFERRED EMBODIMENT

Figure 1:
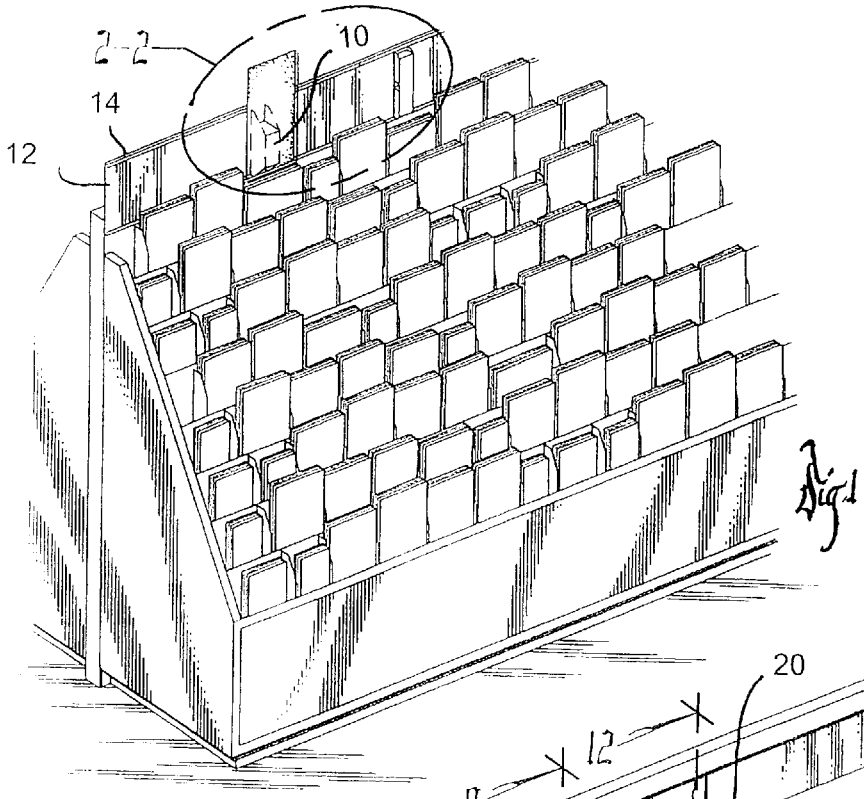
FIG. 1 is a perspective view of a card display showing the display standard in accordance with the present invention.
Figure 2:
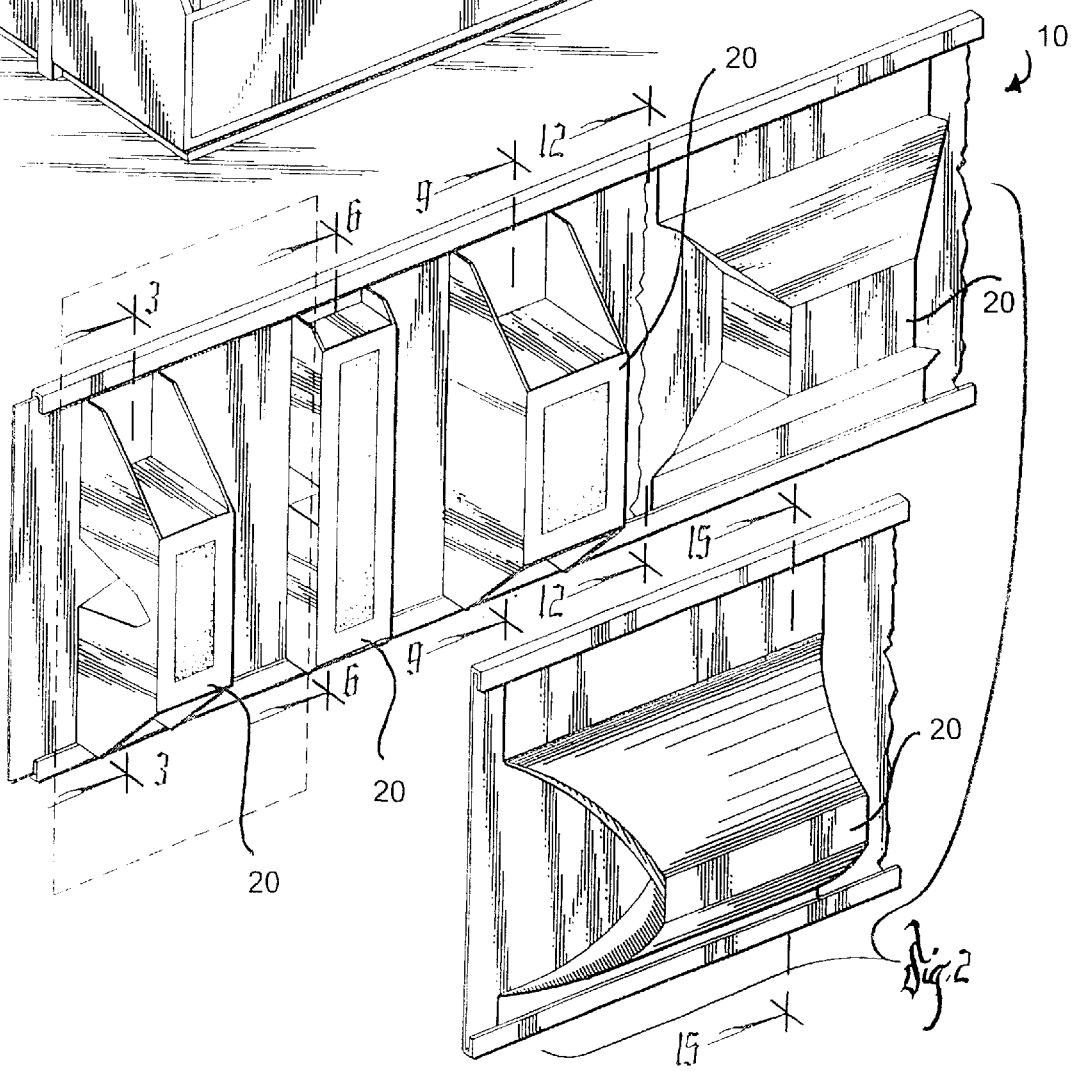
FIG. 2 is a perspective view of several embodiments of the display standard constructed in accordance with the present invention.

Referring to the drawings, a display standard, generally designated at 10, is shown mounted in a shelf or mounting surface 12 having opposing channels 14 (FIGS. 1 and 2). The display standard 10 comprises a planar piece of flexible material 11 having a base member 16, a portion 18 of which is mateable with the opposing channels 14 of the shelf 12 or mounting surface for securing the standard to the mounting surface, a display region 20 for supporting advertising away from the mounting surface, a transition portion 22, and opposing folding tabs 24 for moving the display region from a first position, indicated generally at 26, in which the display standard is substantially flat to a second position 28 in which the display region is moved outwardly away from the mounting surface 12. It will be understood that an advertising display may include several display standards 10 of the present invention without departing from the scope of the present invention.

Figure 3:
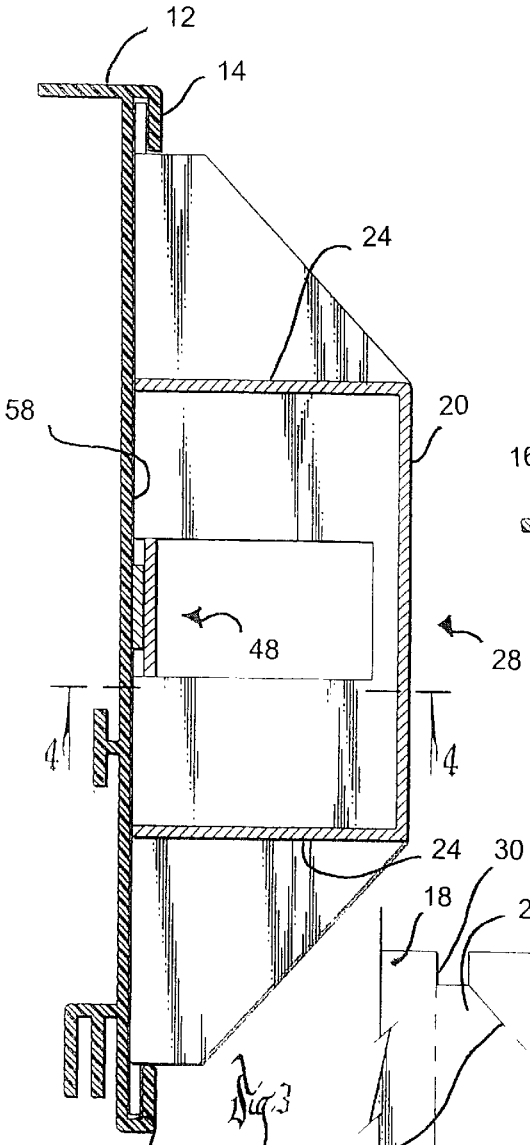
FIG. 3 is a cross section taken along section 3—3 of FIG. 2 showing an embodiment of the display standard having locking tabs.

The display standard 10 is preferably formed from a single sheet of flexible planar material 11, such as cardboard. It will be understood that many other materials including plastic or vinyl may be used for the present invention without departing from the scope of the invention. The planar material 11 includes a generally flat, substantially rectangular base member 16 with opposite top and bottom edge portions or flaps 18 spaced apart a distance greater than the spacing between the slots or interior channel edges 14 of the mounting surface 12. It will be understood that this planar material 11 may be of another shape to meet particular needs, for instance to increase the area for advertising, without departing from the scope of the present invention. As shown in FIG. 3, a portion of each retaining flap 18 of the base member 16 is maintained within molding attached to a store shelf. The molding 12 is provided with upper and lower channels 14 that receive the base member's 16 upper and lower retaining flap, respectively. The base member 16 of the display standard 10 may be sprung into the mounting surface 12 by bowing the base member to slide into the channels 14. A notch 30 may be provided in the retaining flap 18 adjacent the transition portion 22 to allow the retaining flaps to seat properly within the channel, while the transition portion extends forwardly therefrom. Alternatively, a portion (not shown) of the top and bottom retaining flaps 18 may be slanted with respect to the remaining top and bottom edge of the base member to facilitate mounting the display standard 10 in the mounting surface 12.

Figure 5:
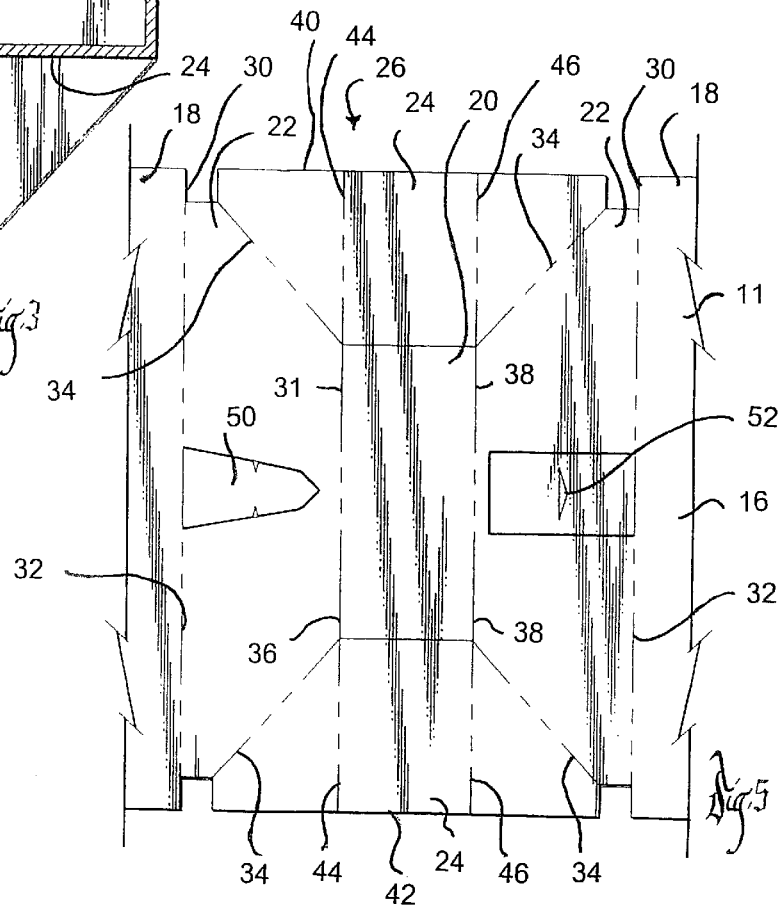
FIG. 5 is a top plan view of the display standard shown in FIGS. 3–5 as unfolded.
Figure 6:
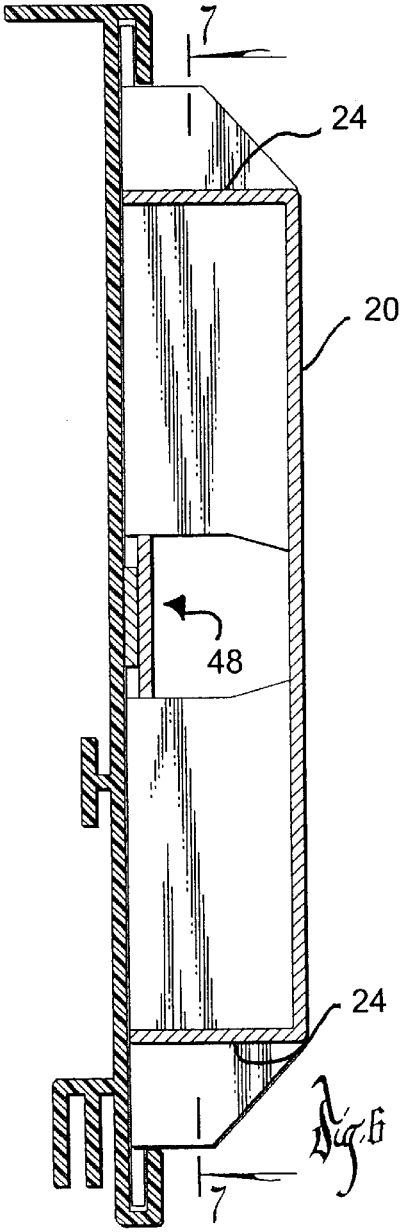
FIG. 6 is a cross section taken along section 6—6 of FIG. 2 showing an embodiment of the display standard having locking tabs.
Figure 7:
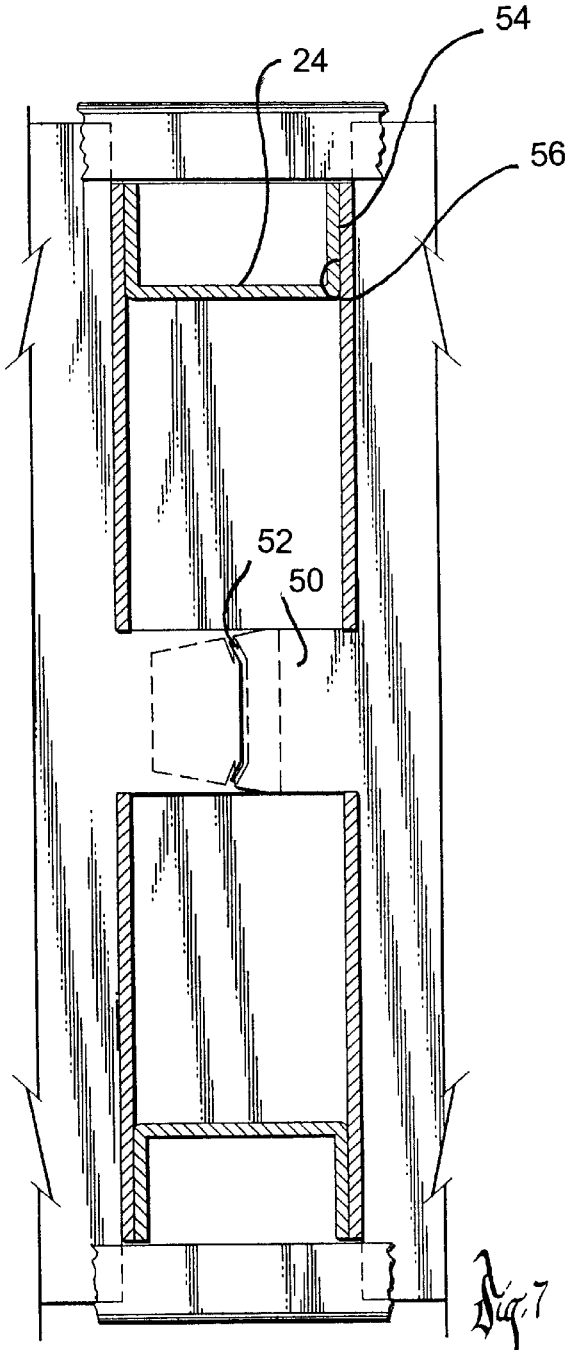
FIG. 7 is a cross section taken along section 7—7 of FIG. 6 showing the locking tabs.
Figure 8:
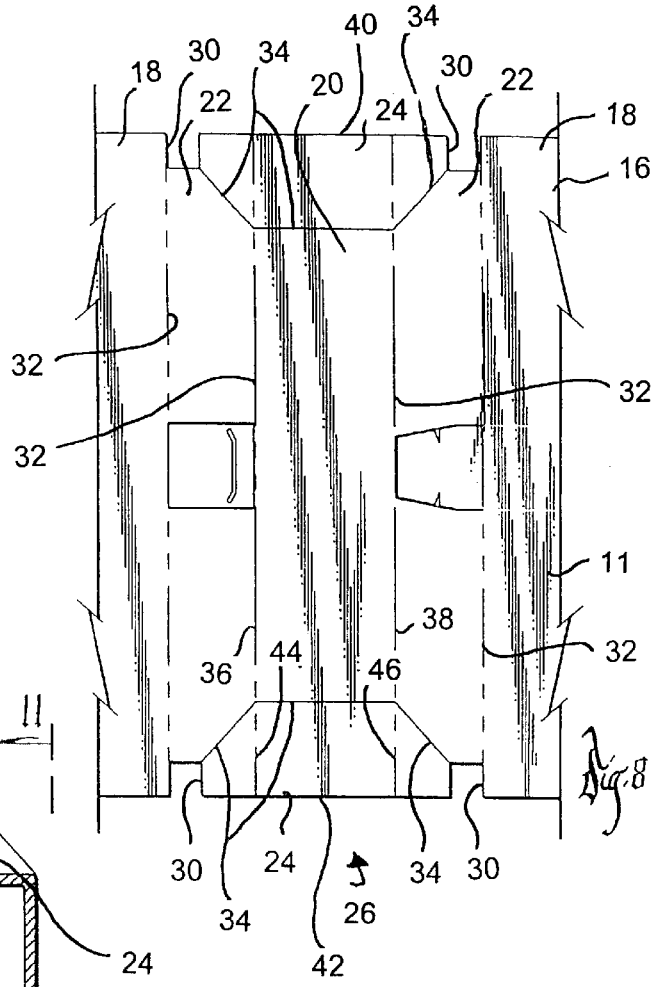
FIG. 8 is a top plan view of the display standard shown in FIGS. 6–8 as unfolded.
Figure 9:
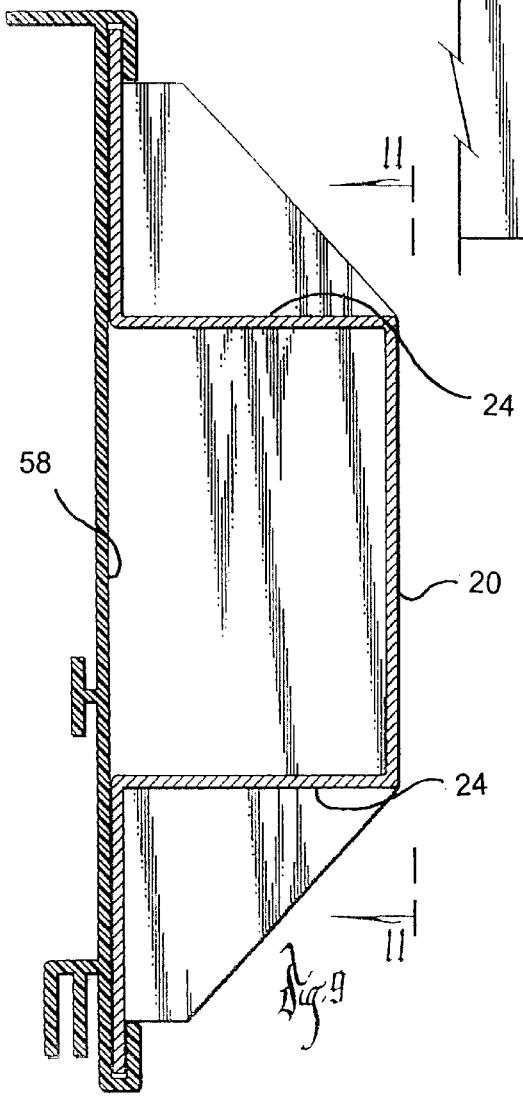
FIG. 9 is a cross section taken along section 9—9 of FIG. 2 showing an embodiment of the display standard having a folding tab retaining flap.
Figure 10:
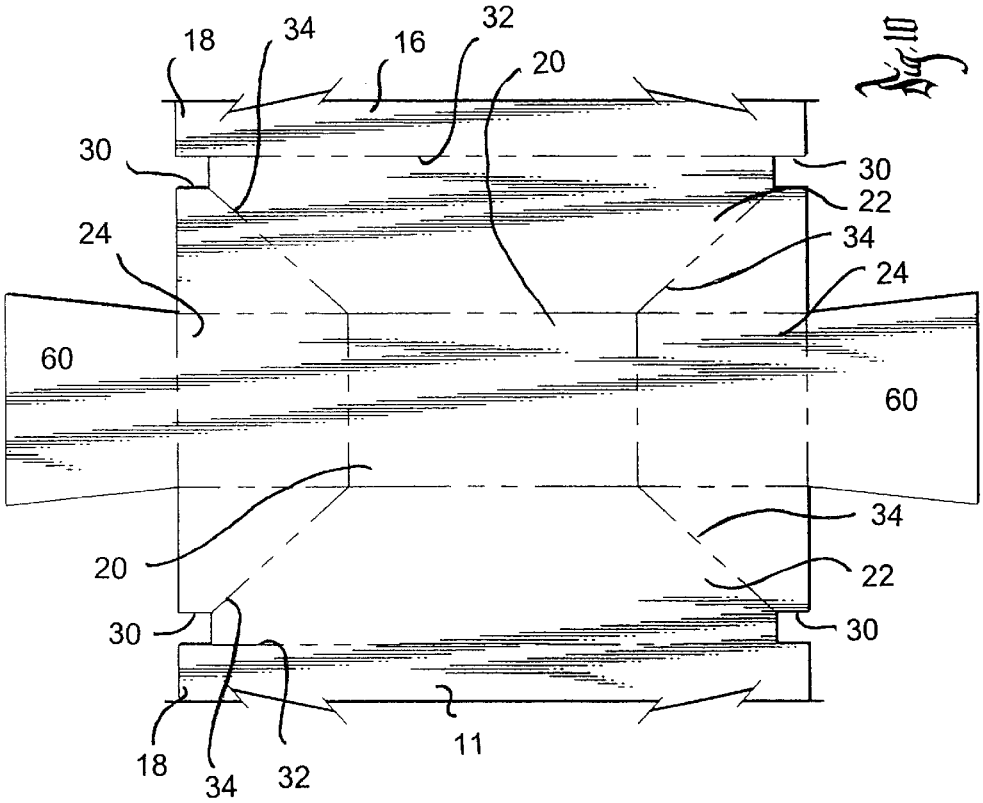
FIG. 10 is a top plan view of the display standard shown in FIGS. 9 and 11 as unfolded.
Figure 11:
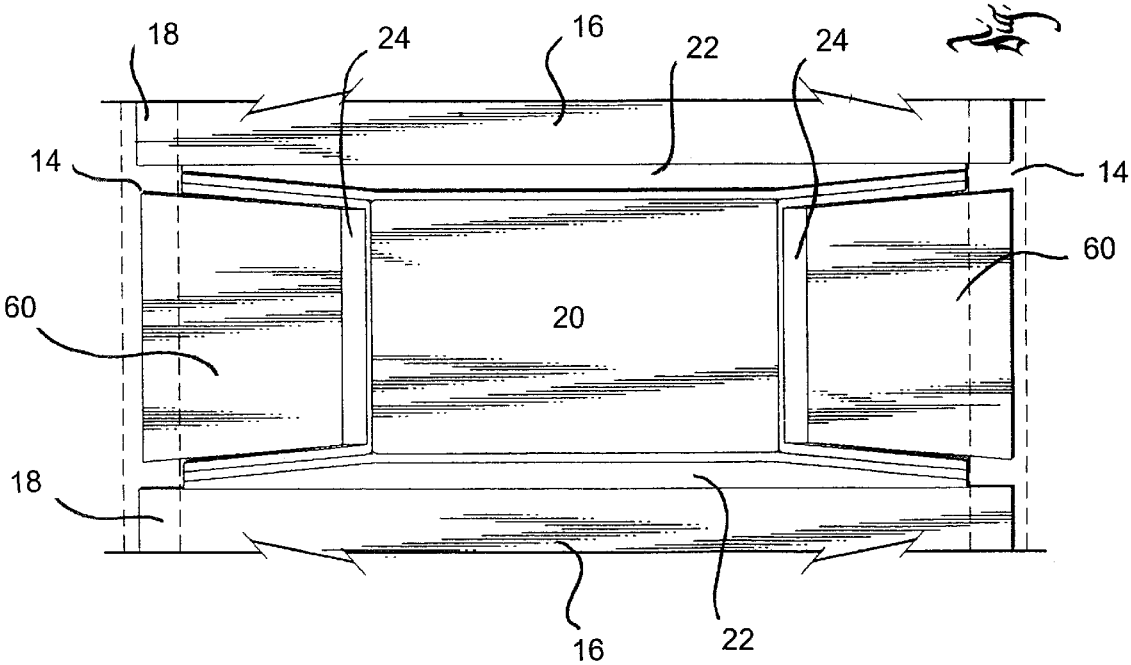
FIG. 11 is a top plan view taken along section 11—11 of FIG. 9.
Figure 13:
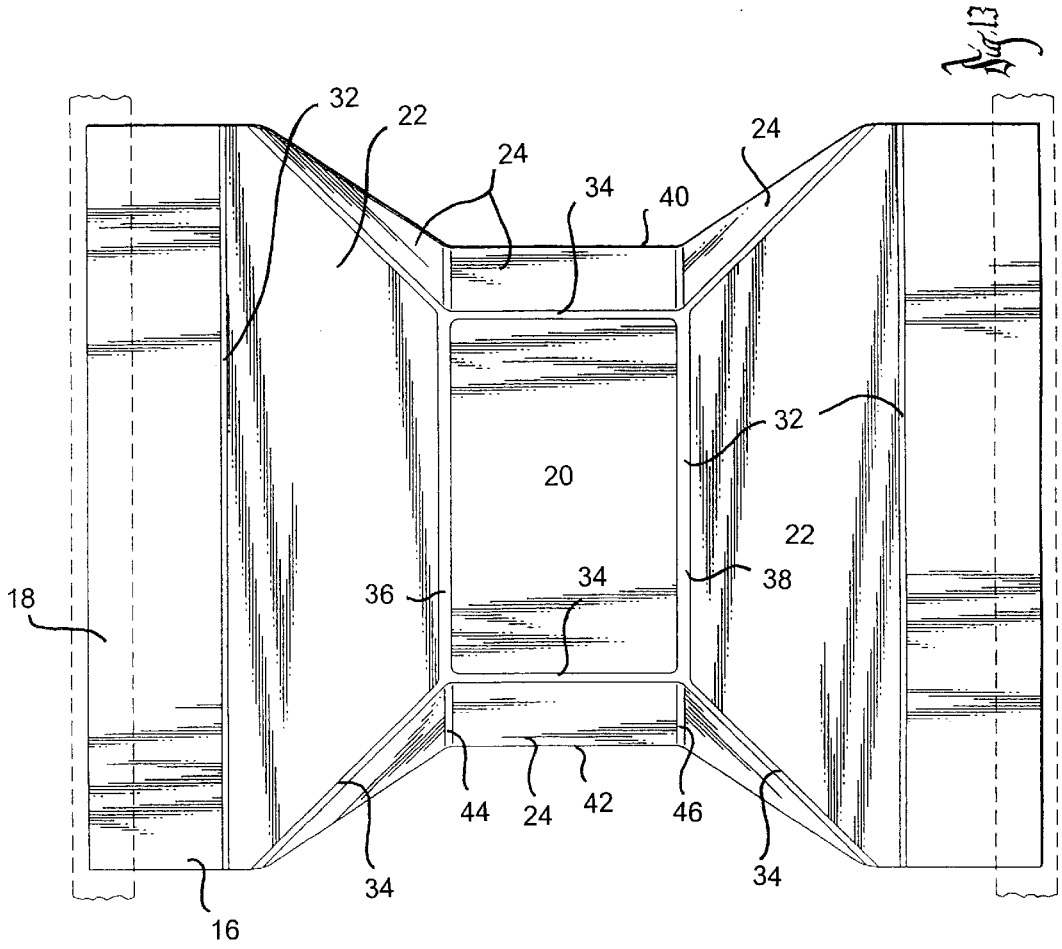
FIG. 13 is a top plan view of the display standard shown in FIG. 12.
Figure 12:
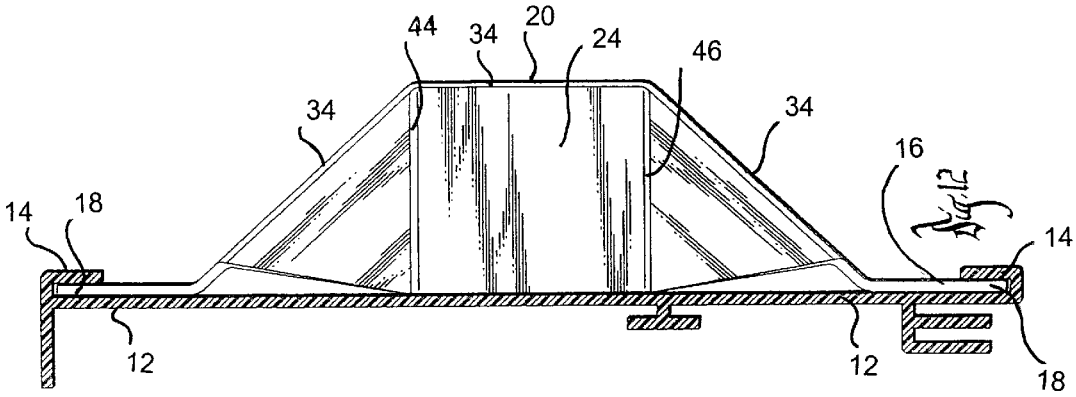
FIG. 12 is a cross section taken along section 12—12 of FIG. 2 showing an embodiment of a display standard.
Figure 15:
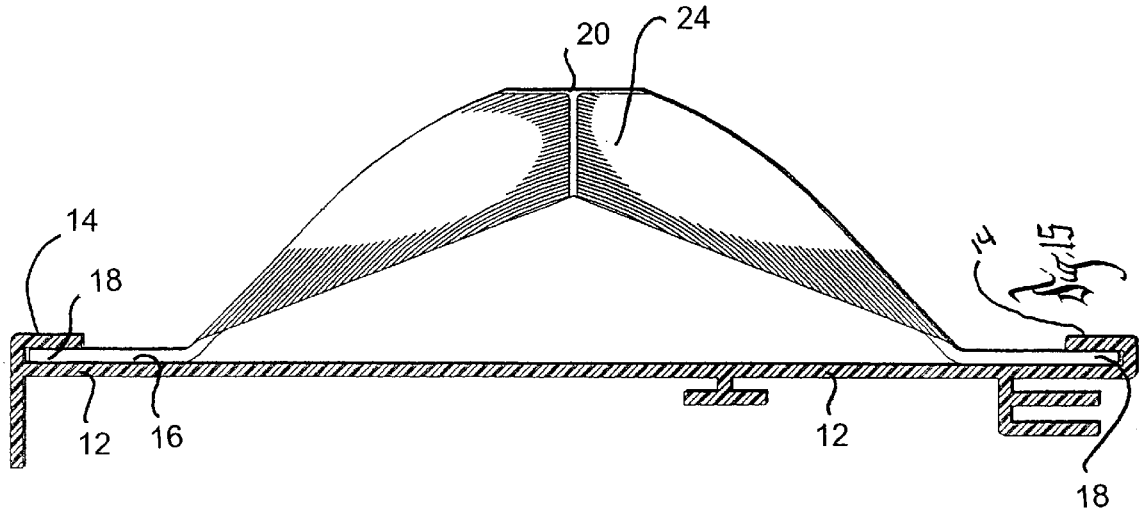
FIG. 15 is a cross section taken along section 15—15 of FIG. 2 showing a display standard.
Figure 14:
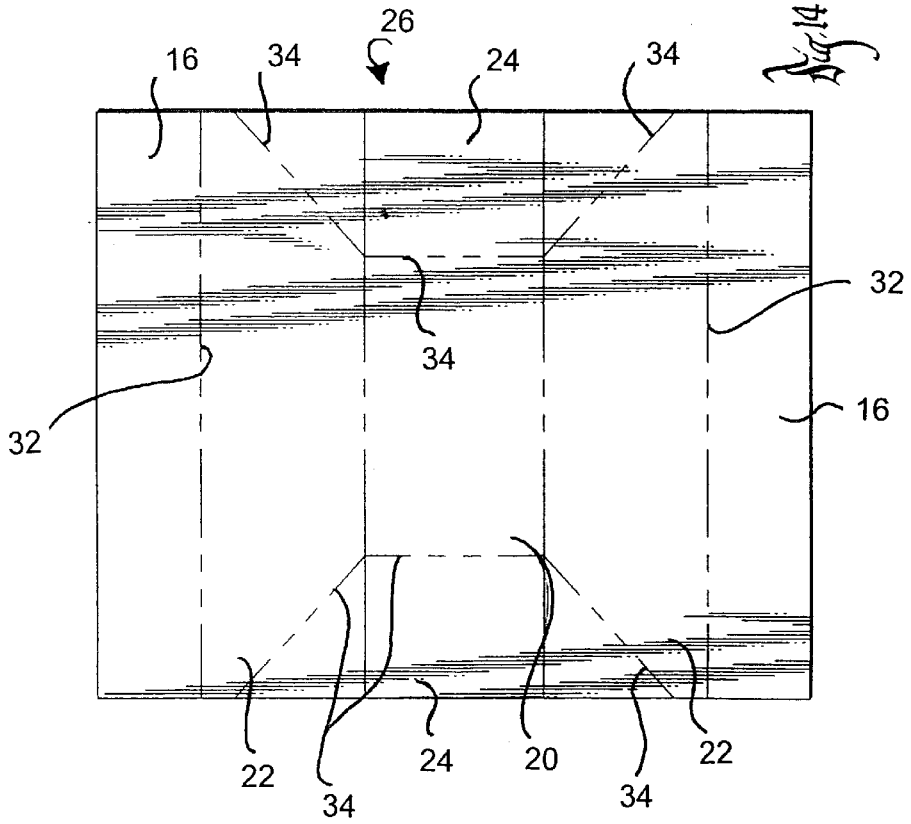
FIG. 14 is a top plan view of the display standard shown in FIGS. 12 and 13 as unfolded.
Figure 17:
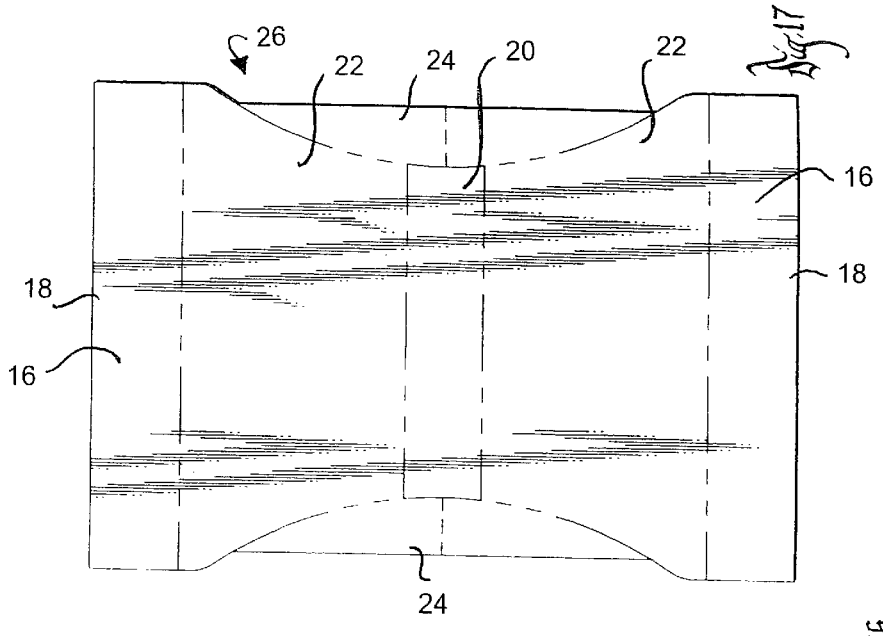
FIG. 17 is a top plan view of the display standard shown in FIG. 15 as unfolded.
Figure 16:
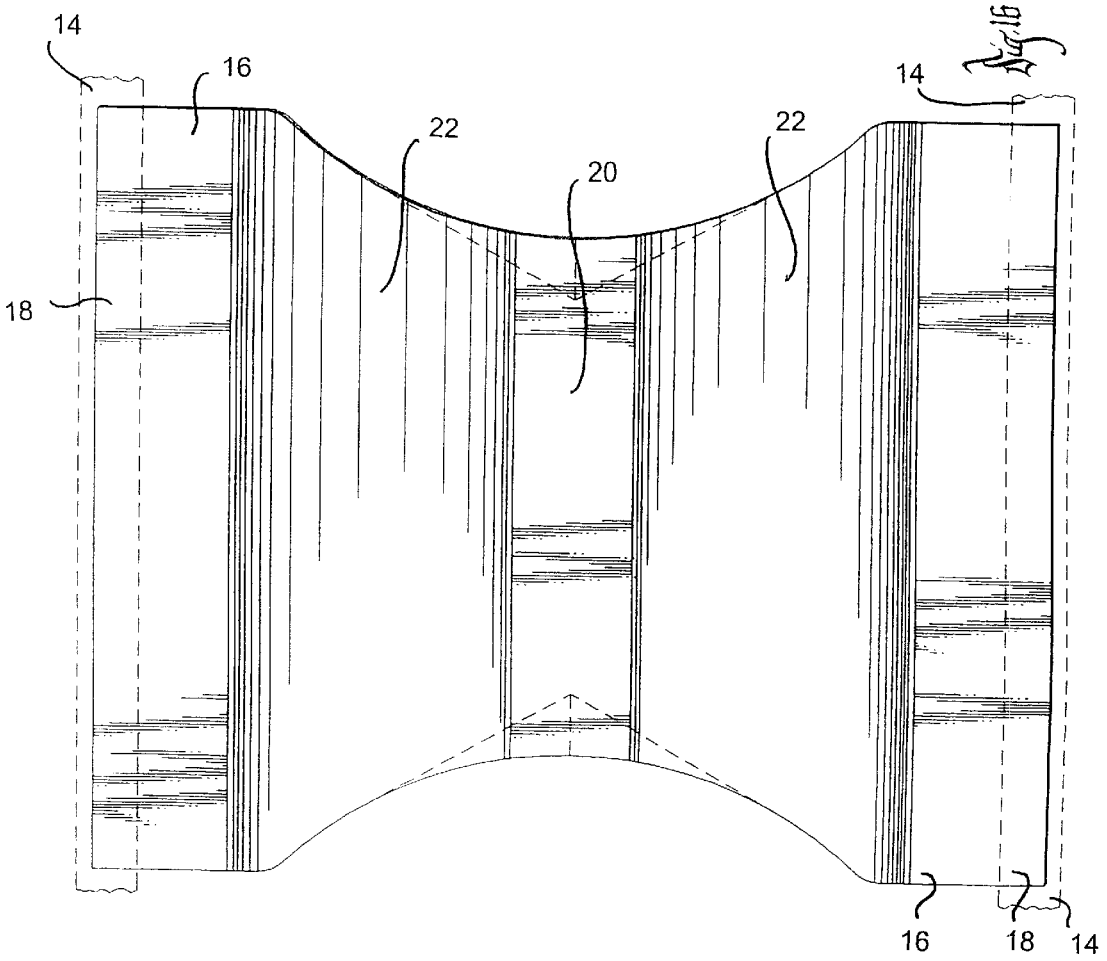
FIG. 16 is a top plan view of the display standard shown in FIG. 15 as folded.

The transition portion 22 is connected to at least one edge of the base member 16 at a line of weakness 32, such as a score line. The transition portion 22 is thus moveable between a substantially flat position planar with the base member 16 as shown in FIG. 5 for example, to a position approximately perpendicular to the base member 16, as shown in FIG. 2. The transition portion 22 extends outwardly from the base member 16 and provides support for the display region 20.

Opposing folding tabs 24 are formed on the planar piece of material 11 to move the display region 20 from a first position 26 in which the display standard 10 is substantially flat to a second position 28 in which the display region 20 is moved outwardly away from the mounting surface 12. Each folding tab 24 is defined by at least one line of weakness 34 formed on the planar piece of material to permit movement of the folding tabs 24 relative to the base member 16. The folding tab 24 is connected to the transition portion 22 at a line of weakness 34, such as a score line, so that the folding tab can project forwardly and substantially perpendicular to the base member 16 and substantially perpendicular to the transition portion as shown in FIG. 2. The line or lines of weakness 34 defining the fold tab may be an arcuate line or several intersecting, straight scored lines.

The planar piece of material 11 includes a display region 20 to display advertising forwardly of the mounting surface 12 as shown in FIG. 1. The display region 20 is bounded by the transition portion 22 and the folding tabs 24 at lines of weakness 32, 34, such as score lines. As such the display region 20 can bend substantially perpendicular to the transition portion 22 and folding tabs 24. The display region 20 is thus moveable from a first position 26 in which the display standard 10 is substantially flat and planar with the base member 16 to a second position 28 in which the display region is moved outwardly away from the mounting surface 12 and supported by the transition portion 22 and folding tabs 24. The display region 20 may have adhesive, hook and loop fastener, or other fastening mechanisms for securing advertising to the display standard 10. Alternatively, or in conjunction, the display region 20 may include advertising material printed directly to the display region.

Each folding tab 24 further may include two lines of weakness extending from a leading edge 36 and trailing edge 38 of the display region 20 to the edge of either the top 40 or bottom edge 42 of the planar piece of material 11, respectively, to define a leading edge 44 and trailing edge 46 of each folding tab. These folding tab edges 44, 46 supply structure for the standard 10 as the standard is folded for supporting the display region 20 outwardly away from the mounting surface 12. It will be understood that the line of weakness may be arcuate in form, and in such embodiment, the folding tab supplies the structure for supporting the display.

In one embodiment (not shown), the display region 20 is slanted with respect to the mounting surface 12. For this, each folding tab's leading edge 44 is fabricated shorter from the corresponding top or bottom edge 40, 42 of the planar piece of material 11 to the display region 20 than the folding edge's trailing edge 46. As the folding tab 24 is folded and the display region 20 is moved outwardly, the display region 20 is thus inclined from the leading edge to the trailing edge relative to the base member 16. To reverse the inclination, the trailing edge 46 for each folding tab 24 is made shorter than the leading edge 44. For a particularly effective advertising campaign, two opposing inclined display standards 10 may be provided on a base member 16. A piece of flexible advertising may be supported as by adhesive between the two inclined standards to provide a concave or convex advertisement.

Figure 4:
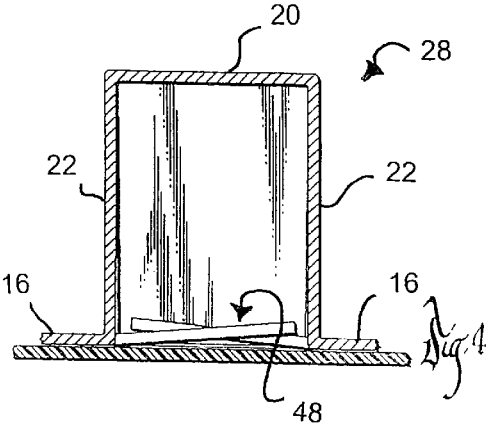
FIG. 4 is a cross section taken along section 4—4 of FIG. 3 showing the locking tabs.

As shown in FIGS. 3–5, the display standard 10 may include locking tabs, indicated generally at 48, to lock the display region 20 in the outwardly protruding position. The locking tab 48 includes a tab 50 on a portion of the folding tab 24 or transition portion 22 of the display standard 10. This tab is inserted into a slot 52 formed in the opposite folding tab or transition portion 22, respectively, to lock the locking tab 50 in the slot. As such, the folding tab 24 and transition portion 22 are locked in a perpendicular relation to the base member 16 and thus lock the display region 20 in the outwardly protruding position. Alternatively, the display standard 10 may be self-locking by using an adhesive backing on an interior portion 54 of the folding tab 24 which adjoins a portion 56 of the transition portion 22 to adhere the standard in the folded position. As such, the standard is easily and permanently locked. For instance, the folding tab may be fabricated from Merchant Product Division's Fasson® Crack-and-Peel label stock.

The folding tabs 24 and transition portions 22 define the height of the display region 20 away from the mounting surface 12, the inclination of the display region 20 and the width of the display region.

As folded, an interior space 58 is defined by the folding tab 24, transition portion 22, and display region 20. This interior 58 may be used to house light bulbs, motors, batteries and other mechanisms to assist with the advertising display.

Each folding tab 24 may further comprise a folding tab retaining flap 60, which adjoins a respective folding tab and is separated therefrom by a line of weakness. This retaining flap 60 covers the mounting surface 12 as the display is folded to provide an aesthetically pleasing display. The folding tab retaining flap 60 may bend relative to the folding tab 24 to be planar with the base member 16 and is configured to be mateable with the opposing channels 14 of the mounting surface 12. As such, these folding tab retaining flaps provide support for the folding tabs 24 and likewise support for the display region 20 as positioned forwardly of the mounting surface 12.

In another embodiment of the present invention (not shown), at least one folding tab 24 or transition portion 22 further includes a slot formed therein for accepting a portion of an advertising display. This slot is preferably formed in the top folding tab with the advertising sliding through this upper slot and resting on an inside wall of the bottom folding tab to hold the advertising on the display standard 10. As such, this display standard 10 permits three-dimensional advertising. Alternatively, an adhesive may be affixed to the folding tab to adhere advertising to the folding tab. The slot or adhesive comprise the mounting means for mounting advertising to the folding tab.

In an another embodiment, the display standard 10 of the present invention is mounted to the mounting surface 12 through an adhesive adhered to a rear side of the base member 16. This adhesive would have a protective sheet to protect the adhesive until the display needed to be mounted to the mounting surface 12. For instance, the base member 16 may be fabricated from Merchant Product Division's Fasson® Crack-and-Peel label stock. As such, the display standard 10 may be mounted on any surface, including existing advertisement, for three-dimensionally advertisement.

In use, the display standard 10 of the present invention is shipped flat to the desired location. For particularly long displays, the display may be folded through a creased line in the advertising display. The display region 20 of the standard is moved to the second, outwardly projecting position by manually squeezing the opposing folding tabs 24 towards each other thereby moving the display region 20 outwardly away from the mounting surface 12. The display standard 10 is then mounted to the mounting surface 12 either by squeezing the advertising display such that the top and bottom edge of the display and the retaining flaps of the base member 16 of the standard are fitted into the channeled molding, or by adhering the display to a mounting surface 12 through an adhesive backing. The display region 20 is either prepared with printed material thereon or is fabricated with securing means such as adhesive or slots to hold additional advertising. A combination of printed material on the display region 20 and further advertising secured to the standard may also be provided. This advertising is very pleasing and eye-catching to consumers.

There has been described several embodiments of an advertising display standard 10. While these particular embodiments have been described in detail, it is not intended that the invention be limited thereto, as it is intended that the invention be as broad in scope as the art will allow and the specification be read likewise. It will therefore be appreciated by those skilled in the art that yet other modifications could be made to the provided invention without departing from the scope as so claimed by the present invention.

That which is claimed:

1. In combination, a mounting surface having opposing slots for supporting a display standard for displaying advertising away from the mounting surface, and a display standard comprising a planar piece of material having a base member having top and bottom retaining flaps mateable with the slots of the mounting surface for securing the standard to the mounting surface, a display region for supporting advertising remotely away from the base member and the mounting surface, opposing folding tabs, each folding tab being defined by at least one line of weakness formed on the display standard between each of said folding tab and both the base member and the display region to permit movement of each folding tab relative to the base member and display region, each folding tab thereby being operably configured upon inward pressure on said folding tabs to move the display region from a first position in which the display standard is substantially flat to a second position in which the display region is moved outwardly away from the base member, and opposing transition portions, each transition portion positioned between a portion of the base member and the display region and separated from both the base member and display region through lines of weakness to permit movement of each transition portion relative to the base member and the display region, the transition portion being operably configured to provide a span between the base member and the display region for moving the display region remotely away from the base member as the standard is positioned in said second position.

2. The combination of claim 1, wherein the mounting surface comprises a pair of opposed channels and the top and bottom retaining flaps are operably configured to be mateable with the opposed channels of the mounting surface to secure the advertising display to the mounting surface.

3. The combination of claim 1, wherein the mounting surface comprises an advertisement having a pair of opposed channels and the top and bottom retaining flaps of the display standard are operably configured to be mateable with the opposed slots of the mounting surface to secure the advertising display to the mounting surface.

4. In combination, a mounting surface for accepting a display standard for displaying advertising away from the mounting surface, and a display standard comprising a planar piece of material having a base member having top and bottom retaining flaps, each of said top and bottom retaining flaps presenting a rearwardly facing portion having an adhesive mounted thereto for mounting the base member of the display standard to the mounting surface for securing the standard to the mounting surface, a display region for supporting advertising remotely away from the base member and the mounting surface, and opposing transition portions, each transition portion positioned between a portion of the base member and the display region and separated from both the base member and display region through lines of weakness to permit movement of each transition portion relative to the base member and the display region and thereby being operably configured upon inward pressure to each transition portion to move the display region from a first position in which the display standard is substantially flat to a second position in which the display region is moved outwardly away from the base member as the display standard is mounted to the mounting surface, the transition portion further providing a span between the base member and the display region.

5. The combination of claim 4, wherein the advertising display further includes opposing folding tabs, each folding tab being defined by at least one line of weakness formed on the display standard between each of said folding tab and both the base member and the display region to permit movement of each folding tab relative to the base member and display region, each folding tab thereby being operably configured to move the display region from a first position in which the display standard is substantially flat to a second position in which the display region is moved outwardly away from the base member.

6. In combination, a mounting surface having opposing slots for supporting a display standard for displaying advertising away from the mounting surface, and a display standard comprising a planar piece of material having a base member having top and bottom retaining flaps, each of said top and bottom retaining flaps presenting a rearwardly facing portion having an adhesive mounted thereto for mounting the base member of the display standard to the mounting surface for securing the standard to the mounting surface, a display region for supporting advertising remotely away from the base member and the mounting surface, and opposing transition portions, each transition portion positioned between a portion of the base member and the display region and separated from both the base member and display region through lines of weakness to permit movement of each transition portion relative to the base member and the display region and thereby being operably configured upon inward pressure to the transition portions to move the display region from a first position in which the display standard is substantially flat to a second position in which the display region is moved outwardly away from the base member, the transition portion further providing a span between the base member and the display region.

7. The combination of claim 6, wherein the mounting surface comprises a pair of opposed channels and the top and bottom retaining flaps are operably configured to be mateable with the opposed channels of the mounting surface to secure the advertising display to the mounting surface.

8. The combination of claim 6, wherein the mounting surface comprises an advertisement having a pair of opposed channels and the top and bottom retaining flaps of the display standard are operably configured to be mateable with the opposed slots of the mounting surface to secure the advertising display to the mounting surface.

* * * * *